US008904590B2

(12) United States Patent
Jungnickel

(10) Patent No.: US 8,904,590 B2
(45) Date of Patent: Dec. 9, 2014

(54) ORAL CARE INSTRUMENT

(75) Inventor: Uwe Jungnickel, Koenigstein/Taunus (DE)

(73) Assignee: Braun GmbH, Kronberg (DE)

( * ) Notice: Subject to any disclaimer, the term of this patent is extended or adjusted under 35 U.S.C. 154(b) by 131 days.

(21) Appl. No.: 13/366,578

(22) Filed: Feb. 6, 2012

(65) Prior Publication Data

US 2012/0198643 A1 Aug. 9, 2012

Related U.S. Application Data

(60) Provisional application No. 61/440,929, filed on Feb. 9, 2011, provisional application No. 61/482,888, filed on May 5, 2011.

(51) Int. Cl.
*A46B 15/00* (2006.01)
*A46B 5/00* (2006.01)

(52) U.S. Cl.
CPC ..... *A46B 15/0002* (2013.01); *A46B 15/0012* (2013.01); *A46B 15/0044* (2013.01); *A46B 2200/1066* (2013.01)
USPC ..... 15/105; 15/167.1

(58) Field of Classification Search
None
See application file for complete search history.

(56) References Cited

U.S. PATENT DOCUMENTS

| | | | | |
|---|---|---|---|---|
| 4,802,255 | A | | 2/1989 | Breuer et al. |
| 5,268,005 | A | | 12/1993 | Suhonen |
| 5,313,909 | A | | 5/1994 | Tseng et al. |
| 5,722,106 | A | | 3/1998 | Masterman et al. |
| 5,815,872 | A | * | 10/1998 | Meginniss et al. ..... 15/22.1 |
| 5,836,769 | A | | 11/1998 | Spencer |
| 5,980,542 | A | | 11/1999 | Saldivar |
| 6,018,840 | A | | 2/2000 | Guay et al. |
| 6,058,541 | A | | 5/2000 | Masterman et al. |
| 6,102,923 | A | | 8/2000 | Murayama |
| 6,151,745 | A | | 11/2000 | Roberts et al. |
| 6,389,636 | B1 | | 5/2002 | Savill |
| 6,402,768 | B1 | | 6/2002 | Liebel |
| 6,475,553 | B2 | | 11/2002 | Guay et al. |
| 6,553,604 | B1 | | 4/2003 | Braun et al. |
| 7,024,717 | B2 | | 4/2006 | Hilscher et al. |
| 7,086,111 | B2 | | 8/2006 | Hilscher et al. |

(Continued)

FOREIGN PATENT DOCUMENTS

| | | |
|---|---|---|
| EP | 2229917 | 9/2010 |
| WO | WO2012040146 | 3/2012 |
| WO | WO2012040181 | 3/2012 |
| WO | WO2012109420 | 8/2012 |

OTHER PUBLICATIONS

International Search Report with written opinion, date mailed Apr. 12, 2012, 12 pages.

*Primary Examiner* — Monica Carter
*Assistant Examiner* — Stephanie Berry
(74) *Attorney, Agent, or Firm* — James E. Oehlenschlager; Amanda T. Barry; George H. Leal

(57) ABSTRACT

An oral hygiene implement is described herein. The oral hygiene implement has a handle; a head, and a neck disposed between the handle and the head. The head has a plurality of contact elements. A sealing element is positioned between the handle and the neck. The sealing element is translucent. An indication element is positioned between the adjacent the sealing element. A light emitting source provides electromagnetic energy to the indication element, and the electromagnetic energy passes through the sealing element.

15 Claims, 13 Drawing Sheets

(56) References Cited

U.S. PATENT DOCUMENTS

| | | | | |
|---|---|---|---|---|
| 7,207,080 | B2 | 4/2007 | Hilscher et al. | |
| 2002/0129454 | A1 | 9/2002 | Hilscher et al. | |
| 2004/0134007 | A1 | 7/2004 | Davies | |
| 2004/0154112 | A1 | 8/2004 | Braun et al. | |
| 2004/0255416 | A1 | 12/2004 | Hohlbein | |
| 2005/0000043 | A1 | 1/2005 | Chan et al. | |
| 2005/0000049 | A1 | 1/2005 | Hohlbein | |
| 2005/0038461 | A1 | 2/2005 | Phillips | |
| 2005/0053895 | A1 * | 3/2005 | Pinyayev et al. | 433/29 |
| 2005/0053896 | A1 | 3/2005 | Pinyayev et al. | |
| 2005/0166344 | A1 | 8/2005 | Hohlbein et al. | |
| 2005/0210612 | A1 | 9/2005 | Hohlbein et al. | |
| 2006/0010628 | A1 | 1/2006 | Moskovich | |
| 2006/0026784 | A1 | 2/2006 | Moskovich et al. | |
| 2006/0052806 | A1 | 3/2006 | Xi et al. | |
| 2006/0080794 | A1 | 4/2006 | Punshon | |
| 2006/0195995 | A1 | 9/2006 | Moskovich et al. | |
| 2006/0272112 | A9 | 12/2006 | Braun et al. | |
| 2007/0049956 | A1 | 3/2007 | Mythen | |
| 2007/0140959 | A1 | 6/2007 | Park et al. | |
| 2007/0251040 | A1 | 11/2007 | Braun et al. | |
| 2008/0189888 | A1 | 8/2008 | Hohlbein | |
| 2008/0244849 | A1 | 10/2008 | Moskovich et al. | |
| 2009/0246430 | A1 | 10/2009 | Kriegel et al. | |
| 2010/0028512 | A1 | 2/2010 | Kriegel et al. | |
| 2011/0067190 | A1 * | 3/2011 | Brattesani | 15/106 |
| 2012/0110763 | A1 | 5/2012 | Jungnickel et al. | |
| 2012/0308953 | A1 | 12/2012 | Altmann et al. | |
| 2013/0000059 | A1 | 1/2013 | Altmann et al. | |

* cited by examiner

ORAL CARE INSTRUMENT

CROSS REFERENCE OF RELATED APPLICATION

This application claims the benefit of provisional application Ser. No. 61/440,929, filed on 9 Feb. 2011, and provisional application Ser. No. 61/482,888, filed on 5 May 2011, both of which are incorporated by reference in their entirety herein.

FIELD OF THE INVENTION

The present invention pertains to a personal hygiene device, more particularly to a personal hygiene device including a feedback system.

BACKGROUND OF THE INVENTION

The utilization of toothbrushes to clean one's teeth has long been known. There are two main classes of toothbrushes available for a user, i.e. manual toothbrushes and power toothbrushes. For manual toothbrushes the user generally provides the majority of the cleaning motion. In contrast, for power toothbrushes the majority of the cleaning motion is provided by the toothbrush. The power toothbrush generally includes a drive mechanism for driving a brush head. Because the toothbrush includes a drive mechanism, power toothbrushes are generally more costly to produce than manual toothbrushes. Power toothbrushes may provide a user with additional features as well. For example, some power toothbrushes can track the time that a brush head is used and indicate to the user the time for replacement of the brush head. As another example, some power toothbrushes can provide an indication to the user as to when the user brushes a predetermined amount of time.

Such features, e.g. replacement of a brush head, brush time indication, are generally thought to be too cost prohibitive to implement in manual toothbrushes. Accordingly, a need exists for a personal hygiene implement which can provide the user with such features while facilitating manufacturing in order to reduce costs.

SUMMARY OF THE INVENTION

An oral hygiene implement constructed in accordance with the present invention comprises a handle, a head, and a neck disposed between the handle and the head. The head comprises a plurality of contact elements. An indication element having an outer periphery. An output source is in signal communication with the indication element. A reflective core is disposed within the indication element, and the reflective core redirects light from the output source to the outer periphery of the indication element.

In some embodiments, an oral hygiene implement constructed in accordance with the present invention comprises a handle; a head, and a neck disposed between the handle and the head. The head comprises a plurality of contact elements. A sealing element is positioned between the handle and the neck. An indication element is positioned adjacent the sealing element. A light emitting source provides electromagnetic energy to the indication element, and wherein the electromagnetic energy passes through the sealing element.

DETAILED DESCRIPTION OF THE INVENTION

Definitions

The following text sets forth a broad description of numerous different embodiments of the present invention. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential to the present invention unless so stated. To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

As used herein, "oral hygiene implement" refers to any device which can be utilized for the purposes of oral hygiene. Some suitable examples of such devices include toothbrushes (both manual and power), flossers (both manual and power), water picks, and the like.

Description

For ease of explanation, the oral hygiene implement described hereafter shall be a manual toothbrush; however, as stated above, an oral hygiene implement constructed in accordance with the present invention is not limited to a manual toothbrush construction.

Figure 1:
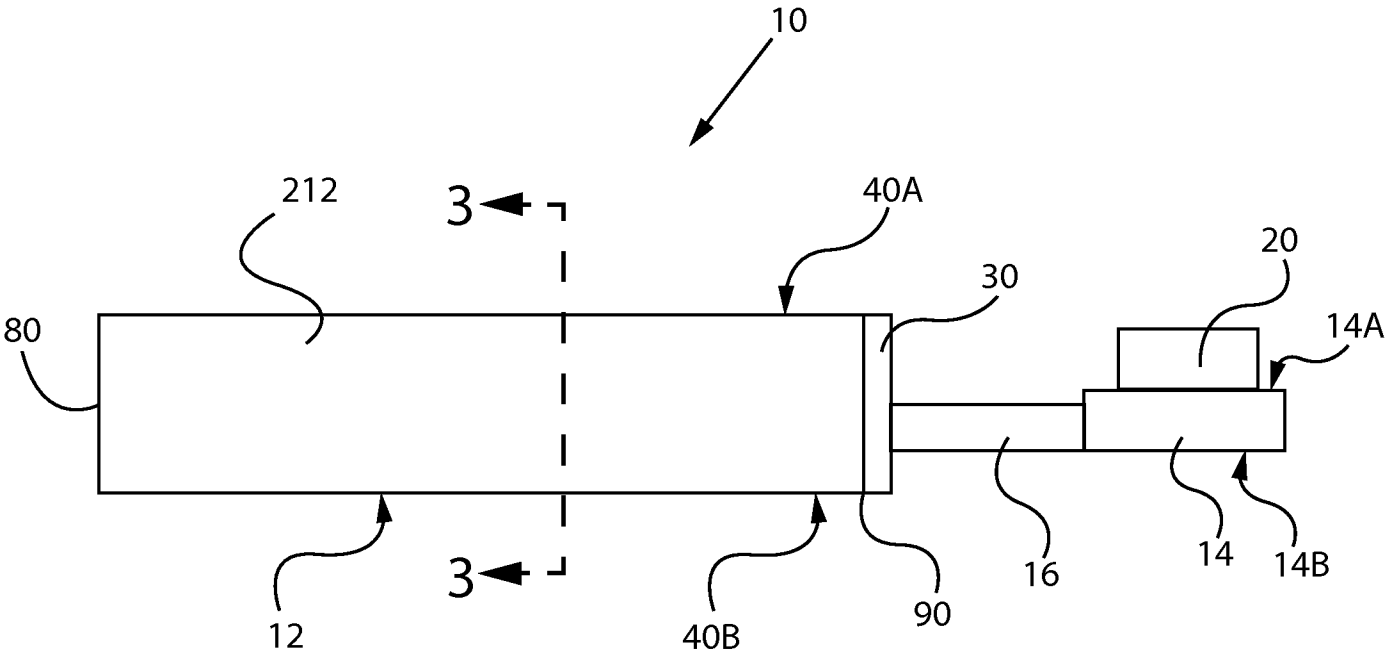
FIG. 1 is a side view showing an oral hygiene implement, e.g. a toothbrush, constructed in accordance with the present invention.

As shown in FIG. 1, a toothbrush 10 comprises a handle 12, a head 14, and a neck 16 extending between the handle 12 and the head 14. A contact element field 20 extends from a first surface 14A of the head 14. The handle 12 may comprise a distal end 80 and a proximal end 90. A tongue cleaner, soft tissue cleanser, massaging element, or the like, may be disposed on a second surface 14B of the head 14. The tongue cleaners, soft tissue cleansers, massaging elements, or the like, are discussed hereafter.

An indication element 30 may be disposed between the handle 12 and the neck 16 adjacent the proximal end 90. The indication element 30 may provide a visible signal to a user for a plurality of conditions. For example, the visible signal may be provided when a user has brushed for an adequate amount of time, e.g. two minutes and/or when the toothbrush needs to be replaced.

The indication element 30 may be placed in any suitable location on the toothbrush 10. For example, in some embodiments, the indication element 30 may surround the neck 16 or may surround the handle 12. As another example, the indication element 30 may surround a portion of the handle 12 and/or a portion of the neck 16. As yet another example, the indication element 30 may be disposed on a back-facing surface 40B of the handle 12 and/or the neck 16. As yet another example, the indication element 30 may be disposed on a front-facing surface 40A of the handle 12 and/or the neck 16.

Figure 2:
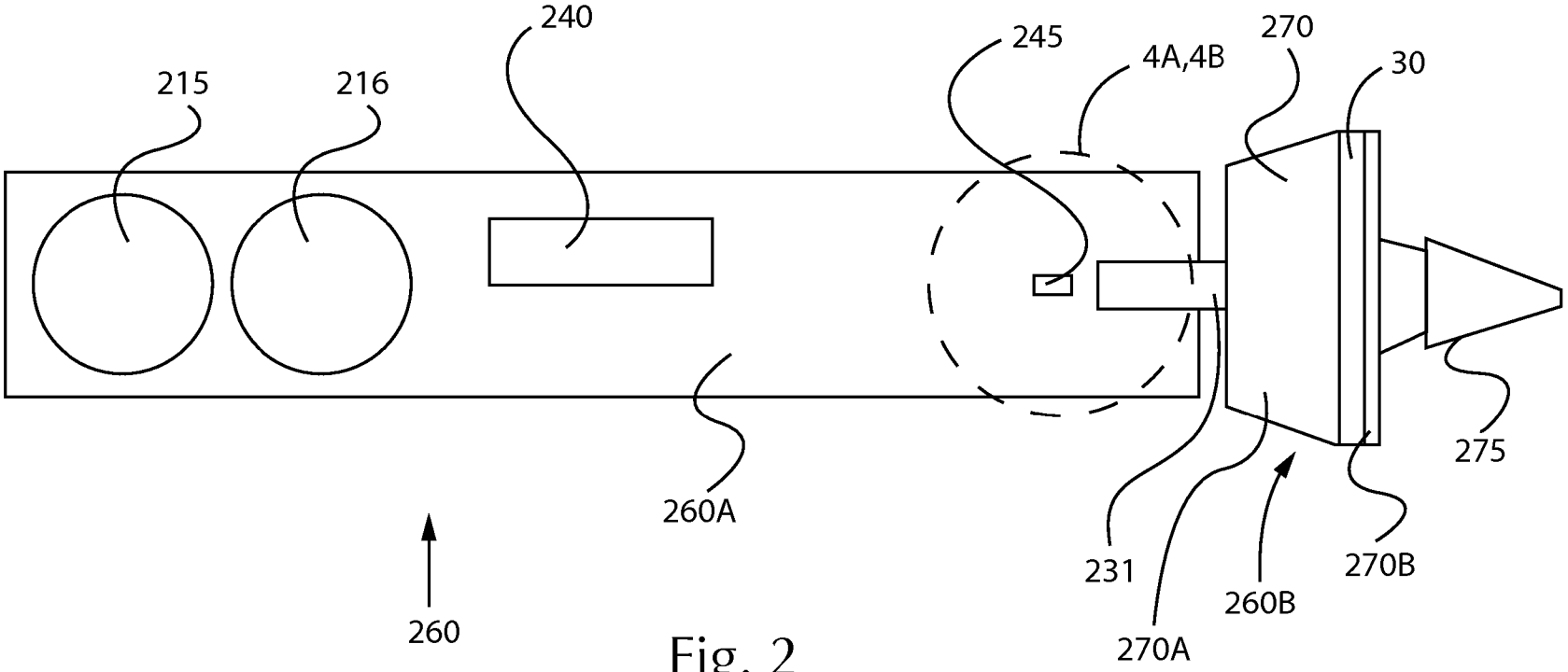
FIG. 2 is a plan view showing a subsection of the toothbrush of FIG. 1.

Referring to FIGS. 1 and 2, in some embodiments, the handle 12 may comprise an outer shell 212. A variety of electronic elements may be disposed within the outer shell 212. For example, within the outer shell 212 there may be housed a power source 215, 216, a timing circuit, a processor 240, a band pass filter, and/or output sources 245, e.g. audible sources, light sources, LED's, combinations thereof, and/or the like. The outer shell 212 may accommodate a plurality of power sources where additional voltage is required, for example to provide threshold voltage for an LED.

In order to facilitate manufacturing, the outer shell 212 may be provided via injection molding. Then an insert 260 may be provided within the outer shell 212. The insert 260 can provide support for the power sources 215, 216, the processor 240, and/or the output source 245. The power sources 215, 216 can be in electrical communication with the processor 240, and the processor can be in electrical communication with the output source 245.

The insert 260 may comprise a base portion 260A and a forward portion 260B. The base portion 260A may provide support as described above and may comprise a PCB (printed circuit board). The forward portion 260B may comprise a stem 275 which can engage a recess in the neck 16 and/or the head 14. The engagement between the stem 275 and the neck 16 and/or head 14 may be permanent such that the neck 16 and/or head 14 are non-removable. In contrast, the engagement between the stem 275 and the neck 16 and/or the head 14 may be configured such that the neck 16 and/or head 14 are removable from the stem 275. In other embodiments, the forward portion 260B may comprise the neck 16 and/or the head 14 integrally formed with other parts of the forward portion 260B. In such embodiments, the forward portion 260B may not include a stem 275.

The forward portion 260B may further comprise the indication element 30, a sealing element 270 and a transmission element 231. The output source 245, e.g. an LED, may be in signal communication with the transmission element 231. The transmission element 231 can transmit a signal from the output source 245 to the indication element 30.

The sealing element 270 can engage an interior surface 375 (shown in FIG. 3) of the outer shell 212 thereby reducing the likelihood of leakage into the cavity of the outer shell 212. The sealing element 270 may comprise any suitable sealing feature. Some examples of sealing features include deformable materials which can be compressed and then recover within the cavity of the outer shell 212, o-rings, etc. In some embodiments, a soft material may be overmolded onto the insert 260, and during assembly of the insert 260 and outer shell 212 the soft material may engage the outer shell 212 to form a seal. In other embodiments, a soft material may be overmolded to the outer shell 212, and subsequently the insert 260 may be inserted into the outer shell 212 and engage the soft material. Still in other embodiments, a soft material may be a discrete element which is either placed on the insert 260 before attachment of the insert 260 to the outer shell 212 or is placed on the outer shell 212 prior to the attachment of the insert 260 to the outer shell 212.

The sealing element 270 may comprise a first portion 270A and a second portion 270B. As shown, the first portion 270A may be disposed adjacent the proximal end 90 of the handle. In an assembled state, the first portion 270A can engage the interior surface 375 (shown in FIG. 3) of the outer shell 212 and a surface of the indication element 30 to reduce the likelihood of moisture entering the outer shell 212. The second portion 270B may be disposed adjacent the neck 16 or the stem 275. In an assembled state, the second portion 270B can engage the neck 16 and the indication element 30 to reduce the likelihood of moisture entering the outer shell 212. Embodiments are contemplated where the sealing element 270 comprise only the first portion 270A or the second portion 270B.

In embodiments where the sealing element 270 includes both the first portion 270A and the second portion 270B, the indication element 30 may be disposed therebetween. In such embodiments, the first portion 270A and/or the second portion 270B may be translucent, transparent, pigmented, or combinations thereof. Embodiments are contemplated where the sealing portion 270 comprises only the first portion 270A or the second portion 270B. In such embodiments, the first portion 270A, the second portion 270B, or the sealing element 270 may be transparent, translucent, pigmented, or combinations thereof.

Additionally, in such embodiments, light provided to the indication element 30 may also be provided to the first portion 270A and/or second portion 270B. In the case where the first portion 270A and/or 270B are transparent, the visible signal may be provided to the user via the indication element 30 and the first portion 270A and/or second portion 270B. In the case where the first portion 270A and/or the second portion 270B are translucent, the visible signal may comprise a tone contrast between the visual signal of the first portion 270A and/or second portion 270B and the indication element 30. In the case where the first portion 270A and/or the second portion 270B are pigmented and translucent or transparent, the light provided to the indication element 30 may blend with the pigment color of the first portion 270A and/or the second portion 270B to produce a unique visual effect. Accordingly, the light provided may comprise a first color while the pigmented first portion 270A and/or pigmented second portion 270B may comprise a second color. When the light having a first color is provided to the first portion 270A and/or the second portion 270B, the first color and the second color may combine to yield a visible signal which comprises a third color that is different than the first color and the second color.

In such embodiments, the overall visible signal may then comprise the first color via the indication element 30 and the third color via the first portion 270A and/or the second portion 270B.

In some embodiments, the first portion 270A and/or second portion 270B may comprise a first color. In such embodiments, an output element, e.g. light emitting element, LED, may output a light having a second color which is similar to the first color. In such embodiments, it is believed that the visual signal provided by the output emitting element may become more visually perceptible by a user. Still in other embodiments, the first portion 270A may comprise a first color and the second portion 270B may comprise a second color which is different than the first color. In such embodiments, the output element, e.g. a light emitting element, LED, may output a light having a third color which is different from the first and/or the second color. The combination of the third color and the first color as well as the combination of the third color and the second color may produce unique visual effects which are perceptible by a user.

The forward portion 260B may be attached to the base portion 260A in any suitable manner. For example, the transmission element 231 may be provided with grooves which engage corresponding rails on the base portion 260A or vice versa. In some embodiments, the base portion 260A may be inserted into the outer shell 212 and subsequently the forward portion 260B may be inserted into engagement with the base portion 260A such that the sealing portion 270 engages the outer shell 212. In other embodiments, the base portion 260A and the forward portion 260B may be assembled prior to their insertion into the outer shell 212. This can facilitate any wiring of the output source 245 which may be required. Subsequently, the insert 260 (including the base portion 260A and the forward portion 260B) may be inserted into the outer shell 212. In other embodiments, the base portion 260A and the forward portion 260B may be integrally formed. However, in such embodiments, additional electrical wiring steps may be required.

Figure 3:
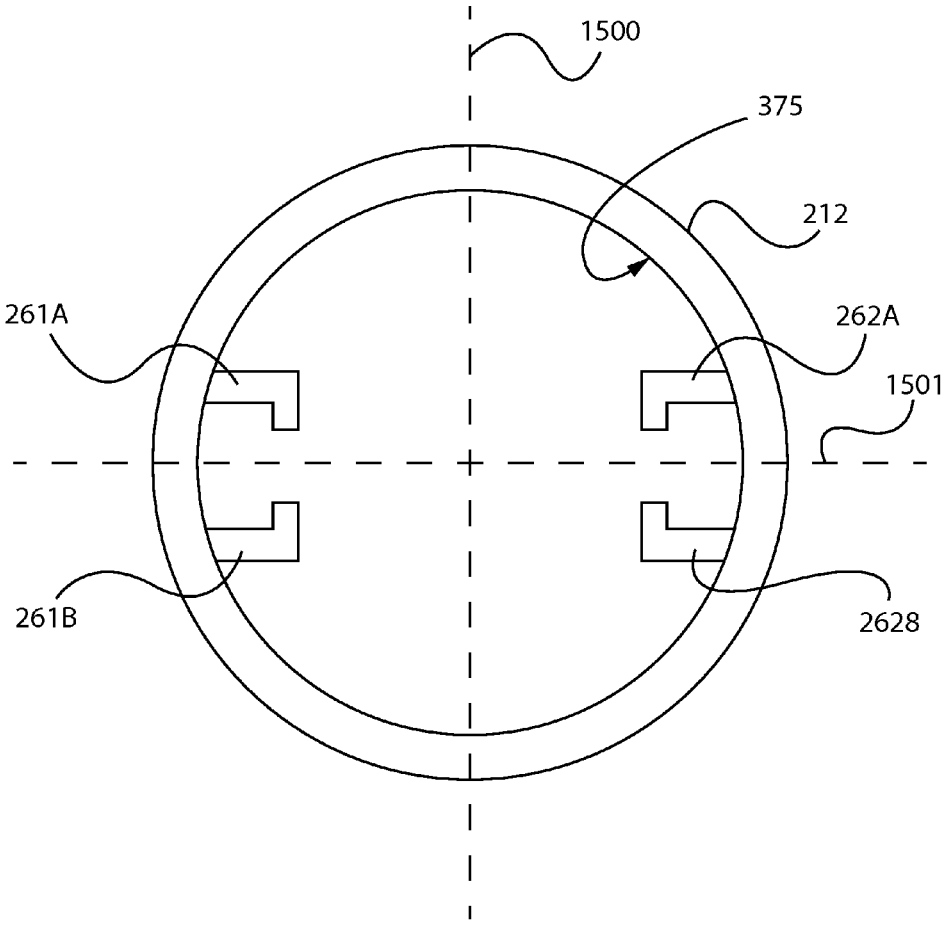
FIG. 3 is a cross sectional view of an outer shell of the oral hygiene implement of FIG. 1.

Referring to FIGS. 2 and 3, the outer shell 212 may comprise supports 261A, 261B, 262A, and 262B. The supports 261A, 261B, 262A, and 262B can fix the insert 260 in the outer shell 212. Either the supports 261A, 261B, 262A, and 262B and/or the insert 260 may comprise detents which engage/receive each other thereby fixing the insert 260 within the outer shell 212. As shown the supports 261A, 261B, 262A, and 262B, can extend from an interior surface 375 of the outer shell 212. As shown, the supports 261A, 261B, 262A, and 262B, may be configured to limit movement of the insert 260 along a lateral axis 1501 and/or movement along a transverse axis 1500, or combinations thereof.

During manufacturing, the outer shell 212 and/or the insert 260 may be produced via injection molding. An output source 245 as well as power sources 215, 216 may be placed on the insert 260. The insert 260 can be attached via the supports 261A, 261B, 262A, and 262B. As an example, the insert 260 may slidingly engage the supports 261A, 261B, 262A, and 262B. The reduced number of parts for this embodiment can reduce the time of manufacture of the oral hygiene implement.

Referring to FIG. 2, the transmission element 231 may be configured to transmit a signal from an output source 245 to the indication element 30. For example, where the output source 245 is an LED, the transmission element 231 may be a light pipe, light guide, fiber optic, or the like. The material selected for the transmission element 231 can be a clear material, transparent material, translucent material, or combinations thereof which transmit light from the LED through the transmission element 231 to the indication element 30. Some examples of suitable materials for the transmission element 231 include glass, polymethylmethacrylate, polycarbonate, copolyester, polypropylene, polyethyleneteraphthalate, combinations thereof, e.g. polyester and polycarbonate, or the like, In some embodiments, the indication element 30 and the transmission element 231 may be unitary. For example, the transmission element 231 and the indication element 30 may be integrally constructed out of a first material during an injection molding process. In some embodiments, transmission element 231 may be a discrete part which is later connected to the indication element 30. In some embodiments, the indication element 30, the transmission element 231, stem 275, and/or base portion 260A may be integrally formed. In some embodiments, the indication element 30, transmission element 231, and/or stem 275, may be integrally formed and subsequently attached to the base portion 260A. The benefit of such embodiments is that a reduced number of components are required for the brush which can reduce the cost and/or time of assembly.

The transmission element 231 may transmit electromagnetic energy, e.g. visible light, to the indication element 30 via internal reflection or external reflection. External reflections are reflections where the light originates in a material of low refractive index (such as air) and reflects off of a material with a higher refractive index (such as aluminum or silver). A common household mirror operates on external reflection.

Internal reflections are reflections where the light originates in a material of higher refractive index (such as polycarbonate) and reflects off of a material with lower refractive index (such as air or vacuum or water). Fiber optic technology operates on the principle of internal reflections.

Refractive index is an optic attribute of any material which measures the tendency of light to refract, or bend, when passing through the material. Even materials that do not conduct light (such as aluminum) have indices of refraction.

Typically, external reflections are most efficient when the angle of incidence of the light is near-normal (i.e., light approaches perpendicular to the surface) and degrade as the angle of incidence increases (approaches the surface at a steep angle). Conversely, internal reflections are most efficient at high angles of incidence and fail to reflect at shallow angles, e.g. normal to the surface. In order to achieve internal reflection, the angle of incidence should be greater than the critical angle. The critical angle is the angle below which light no longer reflects between a pair of materials.

Referring back to FIGS. 2 and 3, for those embodiments of the present invention that utilize external reflection, a foil or some other highly reflective material can be utilized within the outer shell 212. The highly reflective material, e.g. foil, can be disposed on the interior surface 375. In other embodiments, the highly reflective material, e.g. foil can be wrapped around the transmission element 231. One downside to such embodiments is that additional manufacturing steps may be required in order to provide the highly reflective material to the appropriate location(s).

For those embodiments utilizing internal reflection, a material may be selected having high refractive index, e.g. above 1.0. For example, the material selected for the transmission element 231 may comprise a refractive index of greater than about 1.4, greater than about 1.5, greater than about 1.6, and/or less than about 1.7, less than about 1.6, less than about 1.5, any number within the values provided or any ranges within the values provided. In some embodiments, the material selected for the transmission element 231 has a refractive index of between about 1.4 to about 1.6.

Figure 4A:
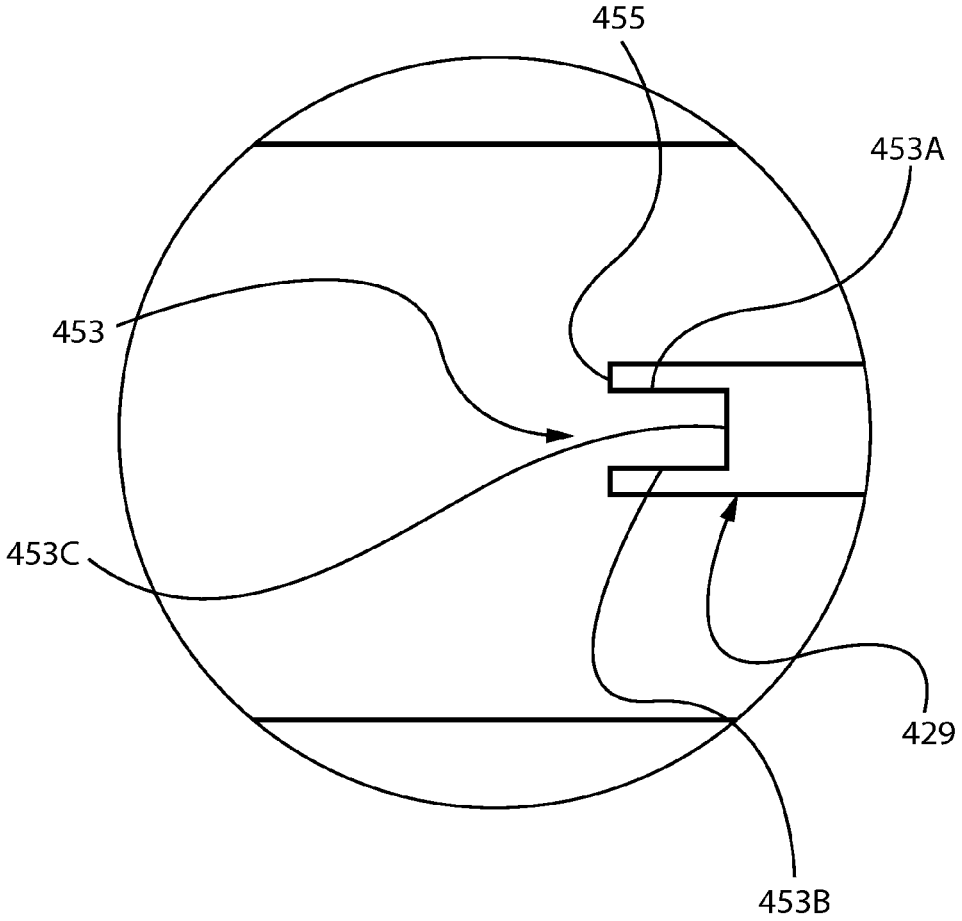
FIG. 4A is a close up view showing a portion of the subsection of FIG. 2.
Figure 4B:
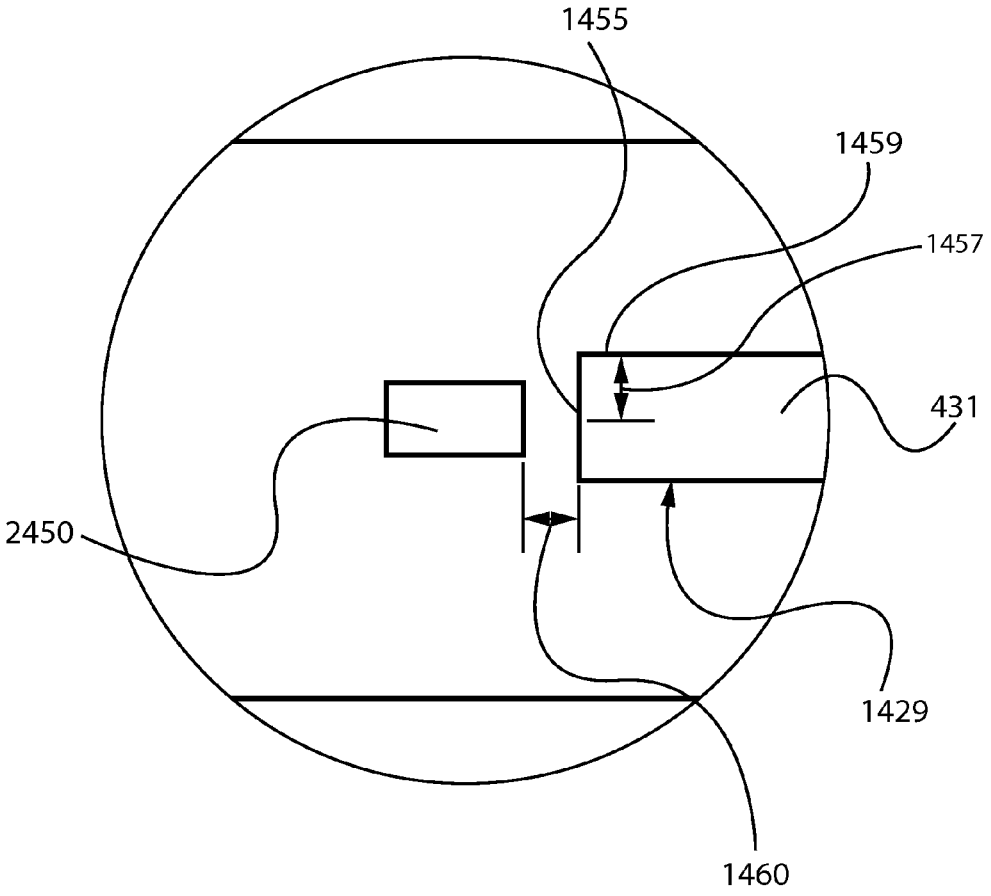
FIG. 4B is a close up view showing another embodiment of a portion of the subsection of FIG. 2A.

Referring to FIGS. 4A through 4B, in such embodiments, an outer surface 429, 1429, of the transmission element 231, 431, may be polished. The polished outer surface 429, 1429 of the transmission element 231, 431, can reduce the amount of leakage of light from the transmission element 231, 431.

In some embodiments, the transmission element 231 may comprise a receptacle 453 for receiving the output source 450, e.g. LED. The receptacle 453 may be disposed on an end 455 of the transmission element 231. One benefit of implementing the receptacle 453 on the end 455 of the transmission element 231 is that during manufacturing, the output source 245 (shown in FIG. 2), e.g. LED, may be inserted into the receptacle 453 thereby reducing the chance for misalignment of the output source 245 with respect to the transmission element 231. This can help reduce the amount of leakage of light between the output source 245 and the transmission element 231.

As stated previously, to achieve internal reflection, impinging light should be above the critical angle. The angle at which light impinges upon the transmission element 231 can be impacted by the distribution angle (discussed hereafter) of the output source 245 or 1450 (shown in FIG. 4B). For those output sources having a small distribution angle, the design of the receptacle 453, e.g. sides 453A and 453B perpendicular to face 453C, may be sufficient to capture the majority of light emitted from the output source 245 for internal reflection. However, any light which is not above the critical angle will generally not be internally reflected. Accordingly, the sides 453A, 453B and/or the face 453C may be configured to increase the amount of light which is above the critical angle. For example, the sides 453A and/or 453B may be tapered toward or away from the face 453C. Similarly, the face 453C may include an angled surface, multiple angled surfaces, curved surfaces, e.g. lens shaped, to increase the amount of emitted light which is above the critical angle.

Referring to FIG. 4B, in some embodiments, a transmission element 431 may be configured with a flat surface on an end 1455 as shown in FIG. 4B. In such embodiments, an output source 2450, e.g. LED, may be positioned a distance 1460 away from the end 1455. In an effort to reduce the amount of light leaked from the output source 2450, distance B (1460) should generally be within the following guidelines.

$$B \leq \frac{A}{\tan(\alpha)}$$

Where α is the half angle α available from a manufacturer's specifications for an output source of light, and where A (1457) is a leg of projection on the transmission element 431. The leg of projection 1457 is the straight line distance from the midpoint of the output source 2450 projected onto the transmission element 431 to an edge 1459 of the transmission element 431.

For those embodiments utilizing internal reflection, the distribution angle of the output source 450, 1450, e.g. LED, should be considered. If the distribution angle is too broad, a portion of the light provided to the transmission element 231, 431 may not be internally reflected and instead will be leaked out of the transmission element 231, 431. Any suitable distribution angle may be utilized. Some examples of suitable distribution angles include greater than about 0 degrees, greater than about 1 degrees, greater than about 2 degrees, greater than about 5 degrees, greater than about 6 degrees, greater than about 8 degrees, greater than about 10 degrees, greater than about 12 degrees, greater than about 14 degrees, greater than about 16 degrees, greater than about 18 degrees, greater than about 20 degrees, greater than about 22 degrees, and/or less than about 22 degrees, less than about 20 degrees, less than about 18 degrees, less than about 16 degrees, less than about 14 degrees, less than about 12 degrees, less than about 10 degrees, less than about 8 degrees, or any number within the values provided or any ranges within the values provided.

Additionally, embodiments comprising multiple output sources are contemplated. For example, a receptacle may be configured such that two LEDs may be positioned therein. A first LED may provide a first output signal for one condition, e.g. brushing time, while a second LED may provide a second output signal for a second condition, e.g. time for brush replacement, wherein the first output signal and the second output signal are different. Similarly, in embodiments where the transmission element does not include a receptacle, a plurality of output sources, e.g. LEDs, may be utilized.

Figure 8A:
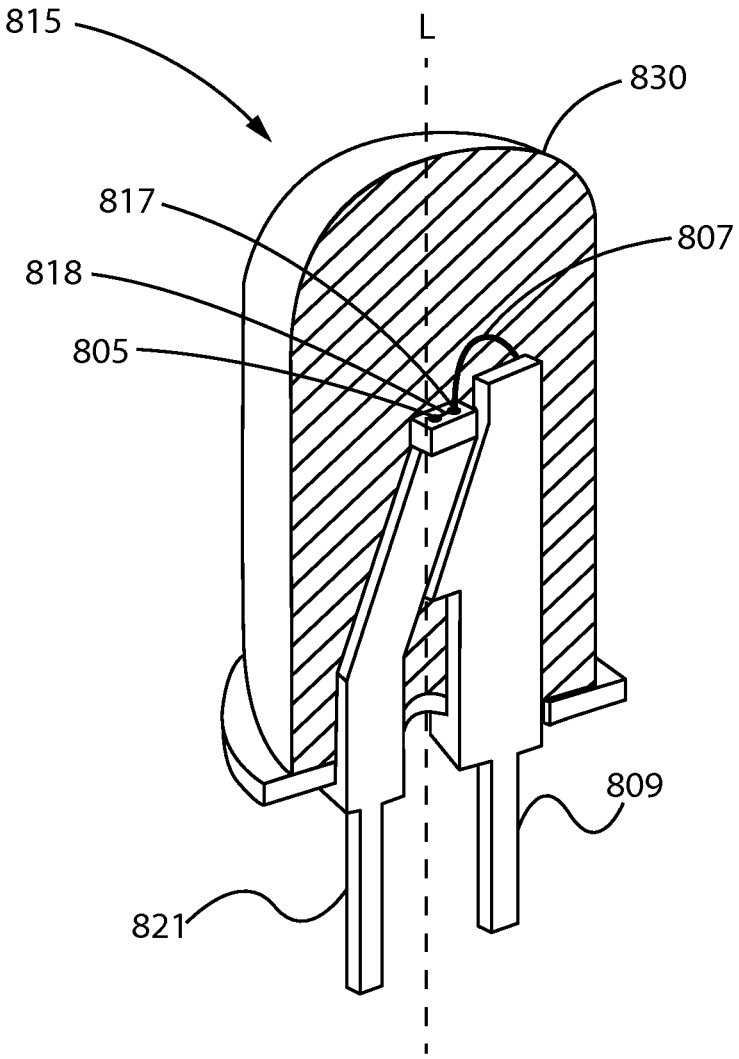
FIGS. 8A-8D are cross sectional views of exemplary LEDs which are suitable for use with the oral hygiene implement of the present invention.

Instead of a plurality of LEDs, embodiments are also contemplated where the output source comprises an LED having multiple dices as described in U.S. Patent Application Publication No. 2005/0053896A1. As shown in FIG. 8A, an LED 815 may include a lens 830, and one positive lead 821 and one negative lead 809. The LED 815 may comprise more than one light emitter and more than one semi-conductor substrate, and can have more than two leads. Embodiments are contemplated where the LED comprises two dices. Additionally, embodiments are contemplated where the LED comprises more than two dices.

For example, the LED 815 may comprise multiple light emitting dices 805 and 817 and a wire bonding 807 and 818. The wire bonding 818 may serve as the connection between the dices 805 and 817. This connection can be either a parallel connection or a serial connection.

Figure 8B:
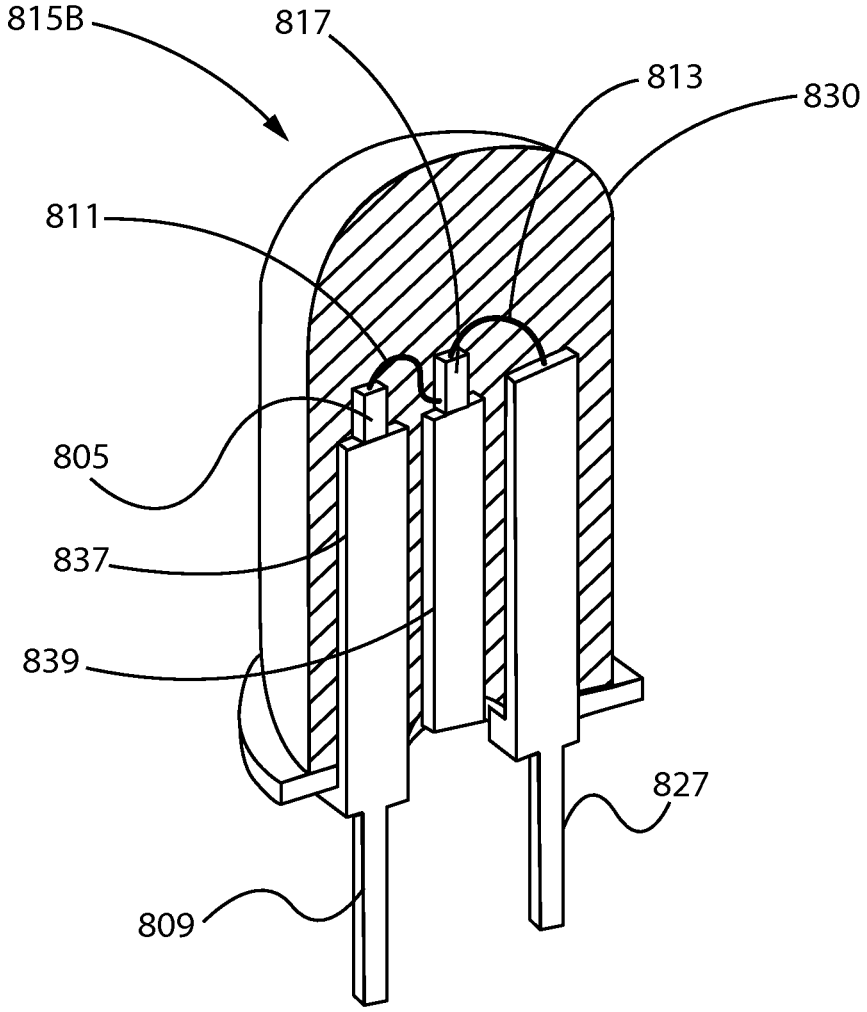

As shown in FIG. 8B, an LED 815B (two wire LED) may comprise multiple dices 805 and 817 connected in series. The LED 815B may include one positive lead 809 and one negative lead 827. As shown, each dice 805 and 817 may have an individual pedestal 837 and 839. The dices have a serial connection 811 connecting the top of dices 805 to the bottom of dices 817, and wire bonding 813 connects the top of dices 817 to the negative lead 827. All light from the light emitting sources may be combined to result in a single light output at lens 830 of LED 815B.

Figure 8C:
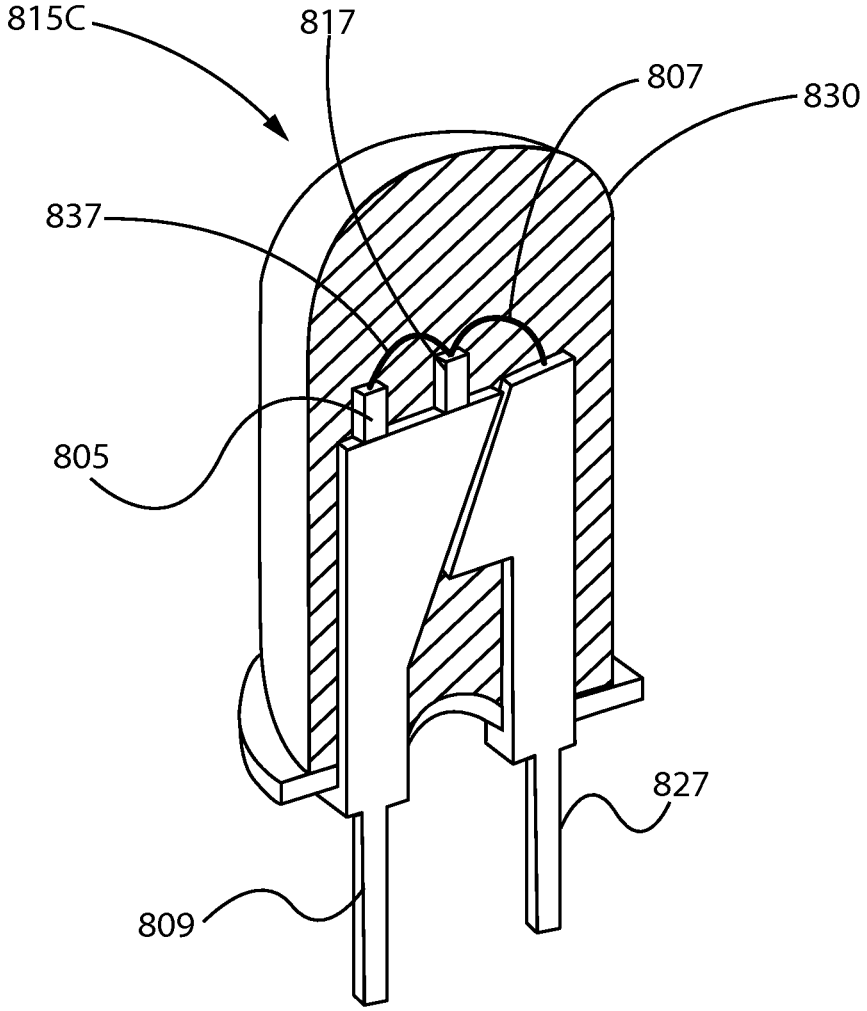

As shown in FIG. 8C, an LED 815C may include multiple dices 805 and 817 connected in parallel. The LED 815C may comprise a single light output, the lens 830, and one positive lead 809, and one negative lead 827. The dices may have a parallel connection, wire bonding 837 connecting the top of dices 805 to the top of dices 817, and wire bonding 807 connecting the top of dices 817 to the top of the common negative lead 827. All light from the light emitting sources can be combined to result in a single light output at lens 830 of LED 815C.

Figure 8D:
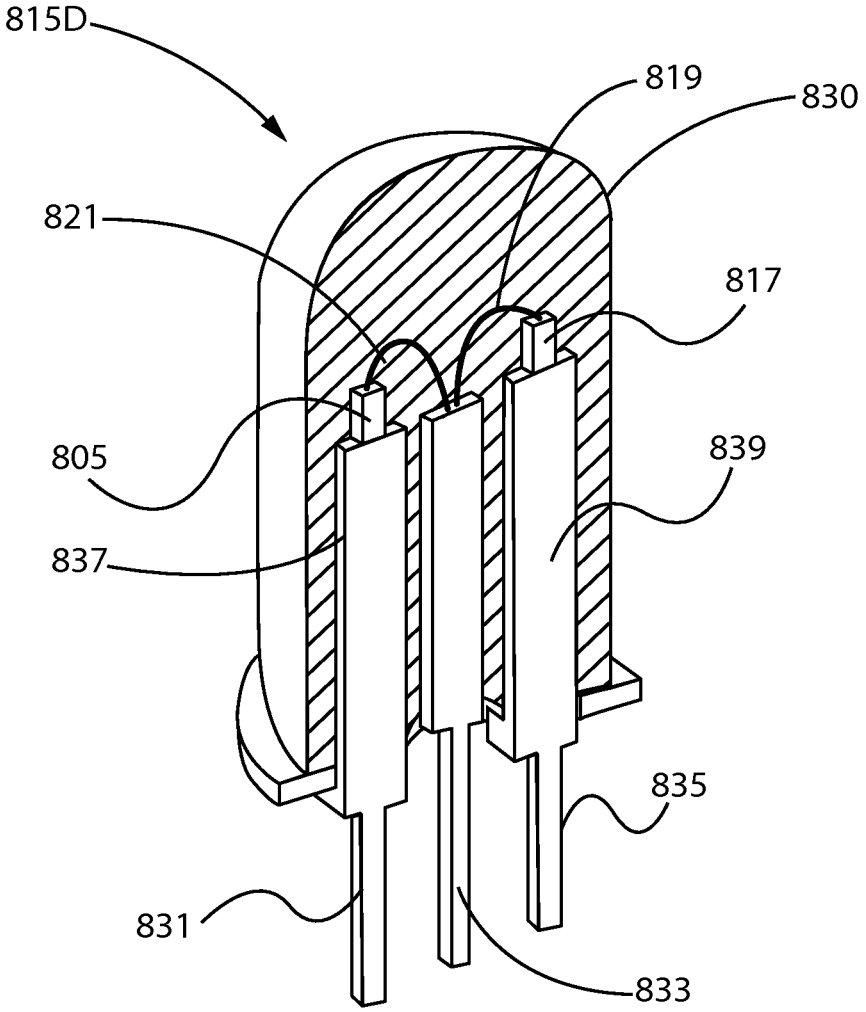

As shown in FIG. 8D, an LED 815D (three wire LED) may include multiple dices 805 and 817. The LED 815D may comprise a lens 830, two semiconductor substrates, dices 805 and 817 shown connected in parallel, wire bondings 819 and 821, one positive lead 833, and two negative leads 831 and 835. This LED 815D also emits light from a single light output, the lens 830. Each dice may have an individual pedestal 837 and 839. It is also contemplated that the LED 815D can comprise two positive leads, and one negative lead; and the dices 805 and 817 can be connected in series.

Additionally, the LED can comprise more than two semiconductor substrates having light emitting properties, and the LED can comprise more than two leads. The LED can have a common or shared lead, or can have individual leads for each semi-conductor substrate having light emitting properties. Further, each semi-conductor substrate having light emitting properties can be individually powered by a separate power source, such as a battery.

One advantage of a three wire LED, e.g. LED 815D, is that the dices 805 and 817 may be independently operated. For example, where the LED 815D comprises two positive leads, the dices may be independently controlled. So, the first dice 805 may be operated at eighty percent capacity while the second dice 807 is operated at twenty percent capacity. As another example, the first dice 805 may be operated at fifty percent while the second dice 817 is operated at 100 percent. There are countless combinations for operating levels of the first dice 805 and the second dice 817. It is believed that such combinations can achieve color blends which create a unique visual effect for the user.

For two wire LEDs light blends are also possible. For example, the polarity of the supply voltage can be switched at a high enough rate, e.g. higher than 70 Hz, such that the dices can be driven and create a blended color effect. When the polarity of the supply voltage is in a first state, a first dice may be energized. When the polarity of the supply voltage is in a second state, a second dice may be energized. If the polarity of the supply voltage is switched fast enough, a user may perceive a color blend. The switching rate of the polarity of the supply voltage may be greater than about 70 Hz, greater than about 80 Hz, greater than about 90 Hz, greater than about 100 Hz, greater than about 110 Hz, greater than about 120 Hz, greater than about 130 Hz, less than about 130 Hz, less than about 120 Hz, less than about 110 Hz, less than about 100 Hz, less than about 90 Hz, or any number within the values provided or any ranges within the values provided.

As stated above, these dices can be electrically connected in parallel or in series. When they are connected in series, all current considerations are the same as for one single dice. The total voltage can be approximated by the equation below:

$$V=V_{f1}+V_{f2}+\ldots+V_{fn}$$

where n is equal to the number of dices and $V_f$=forward voltage for a particular dice. If the dices are connected in parallel, the total voltage is approximately that of a single dice.

Serial connection works well because it adjusts for differences between the dices. When the dices are connected in series, they automatically adjust their forward voltages and their luminous intensity become very close. In either arrangement the two dices have approximately the luminous intensity of $1.6\times P_i$, where $P_i$ is luminous intensity of a single dice. A three dices LED will likely have the luminous intensity of about $2.26\times P_i$. (Interference between the dices can prevent the luminous intensity calculation from being a multiplier by the number of dice.) These dices can deliver the same color of light, or they can have different colors of light. However, if each individual light emitter emits the same light, the luminous intensity of that color light from that one single LED is greater than a single standard LED emitting light of one color.

A single LED could also contain two dices emitting different colors of light, for example a wavelength selected from the range of greater than about 370, 380, 390, 400, 425, 440, 450, 475, 480 and/or less than about 500 nanometers. The dices could also be selected such that the dices emit light of a different wavelength within the same color range; for example the dices could emit light having different wavelengths that result in the color blue. Further, the combination of the different wavelengths of light at the single optical output of the LED (the lens) could result in a specific combination of colors that delivers an oral care benefit. Some colors are difficult to achieve by a single wavelength of light; this invention can be used to produce light of one of these unique colors. Thus the combination of different colors at the single optical output may result in a color that cannot be achieved by one dice alone.

For those embodiments comprising multiple LEDs or an LED with multiple dices, the oral hygiene implement of the present invention may provide the user with multiple signals. For example, a first dice may be energized providing the user with a first visual indication. The first visual indication may correlate to a predetermined amount of time brushed by the user, for example. A second dice may be energized providing the user with a second visual indication. The second visual indication may signal the user that it is time to replace the oral care device. In such embodiments, the first visual indication may comprise first color while the second visual indication comprises a second color which is different than the first color. Any suitable colors may be utilized.

Figure 5:
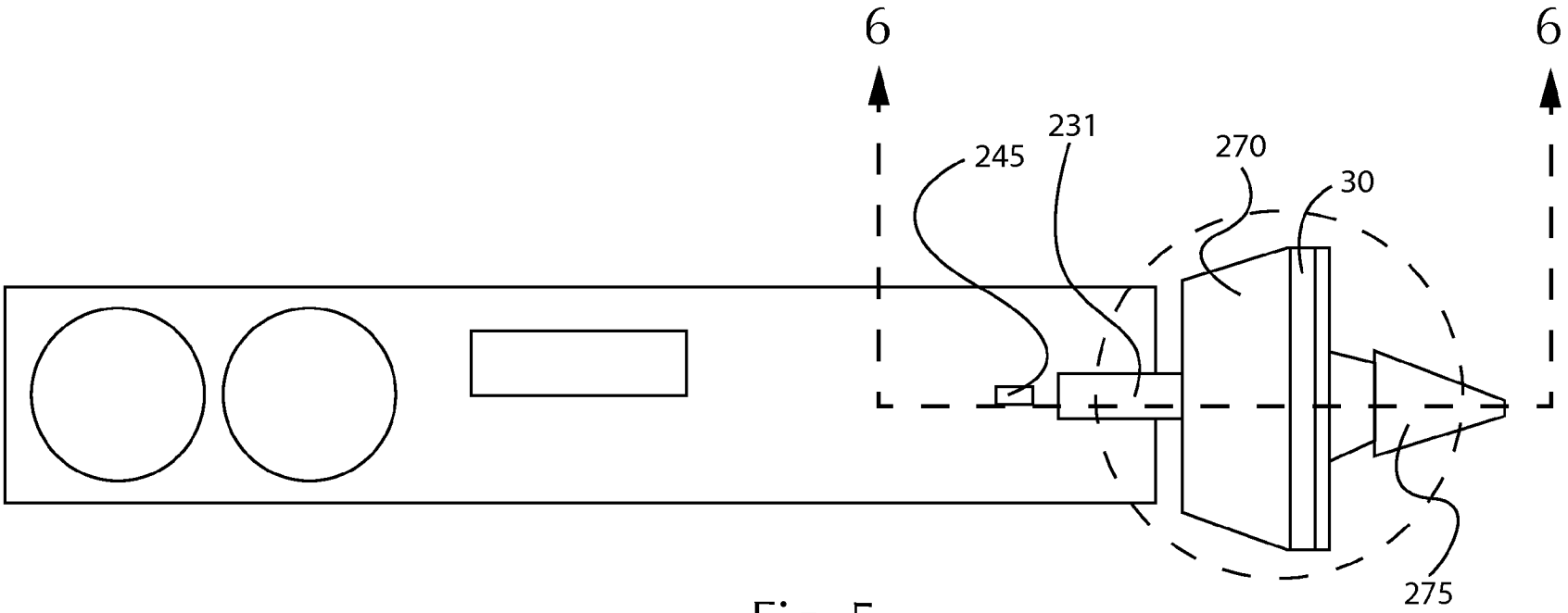
FIG. 5 is a plan view showing the subsection of FIG. 1.

Referring to FIG. 5, as stated previously, the transmission element 231, 431, can transmit a signal, e.g. electromagnetic energy, from the output source 245, 2450, to the indication element 30. In an effort to reduce the amount of energy leaked through the stem 275, a reflective core 461 (shown in FIG. 6) may be utilized. For those embodiments where forward portion 260B comprise the neck 16 and/or head 14, a reflective core may be utilized in the neck 16 and/or head 14.

Figure 6:
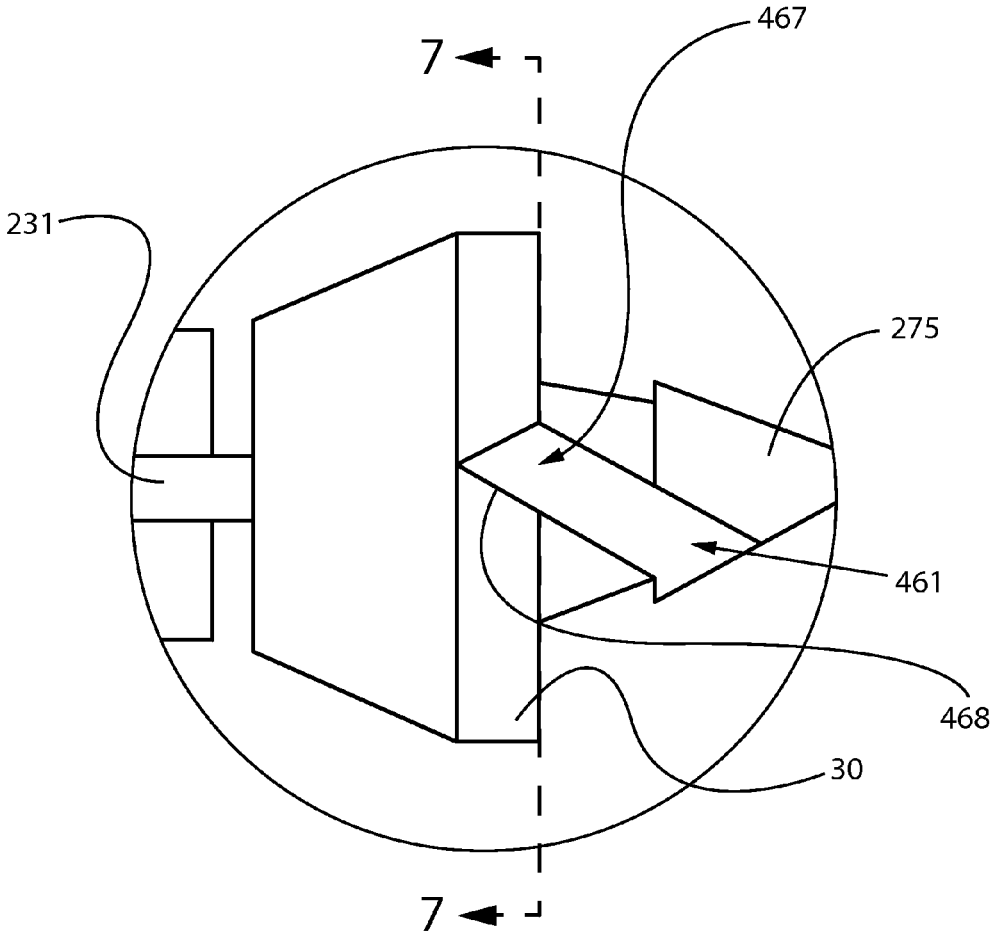
FIG. 6 is close up view showing an indication element of the oral hygiene implement of FIG. 1.

Referring to FIG. 6, as shown, a reflective core 461 may be disposed in the indication element 30 and extend to the stem 275. The reflective core 461 can reduce the amount of light which is lost through the stem 275 and into the neck and/or head of the brush. Additionally, the reflective core 461 can assist in distributing light through the indication element 30 to a periphery 430 of the indication element 30. Also, in some embodiments, the reflective core 461 may be configured to assist in providing light to the first portion 270A and/or second portion 270B.

Figure 7B:
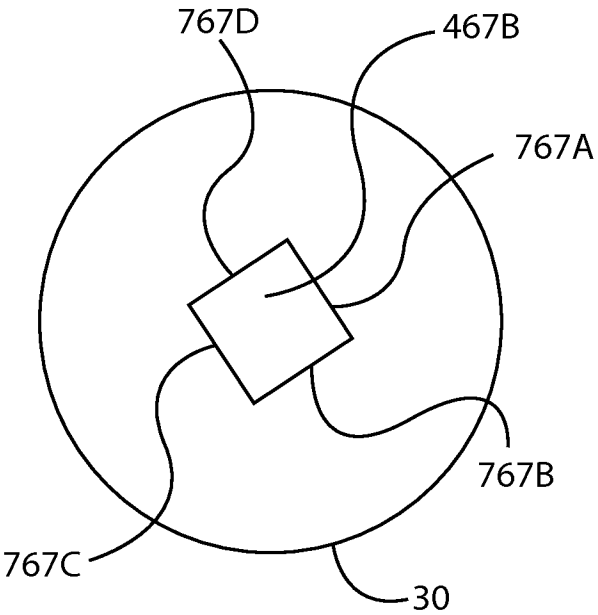
FIGS. 7A-7D are schematic representations showing embodiments of reflective cores and an outer surfaces of indication elements.
Figure 7A:
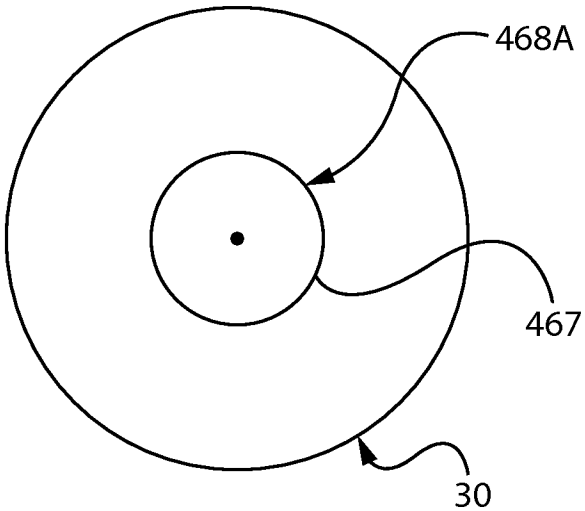
Figure 7D:
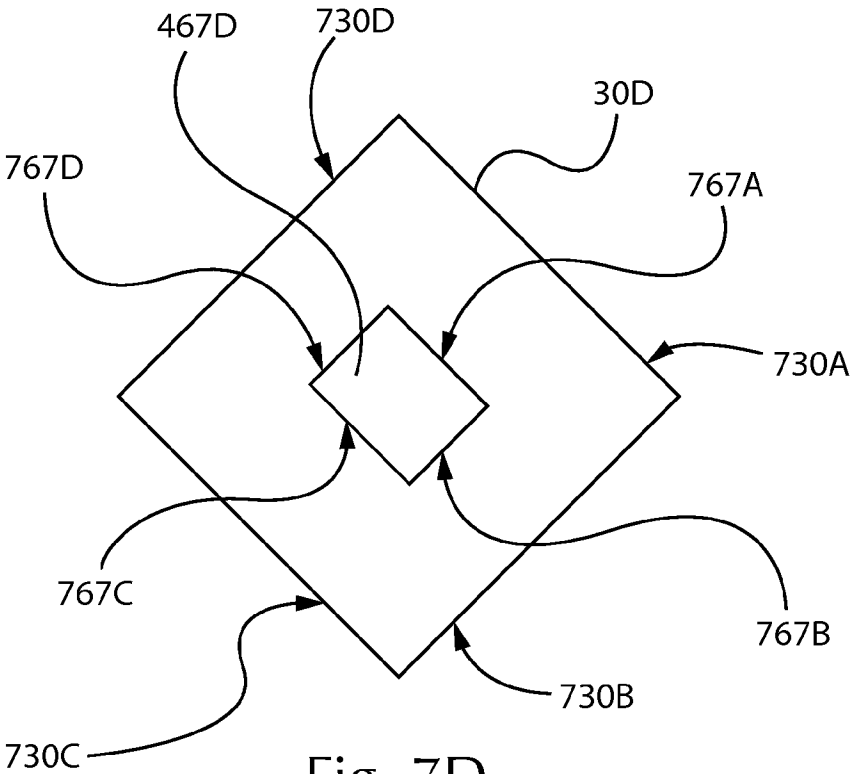
Figure 7C:
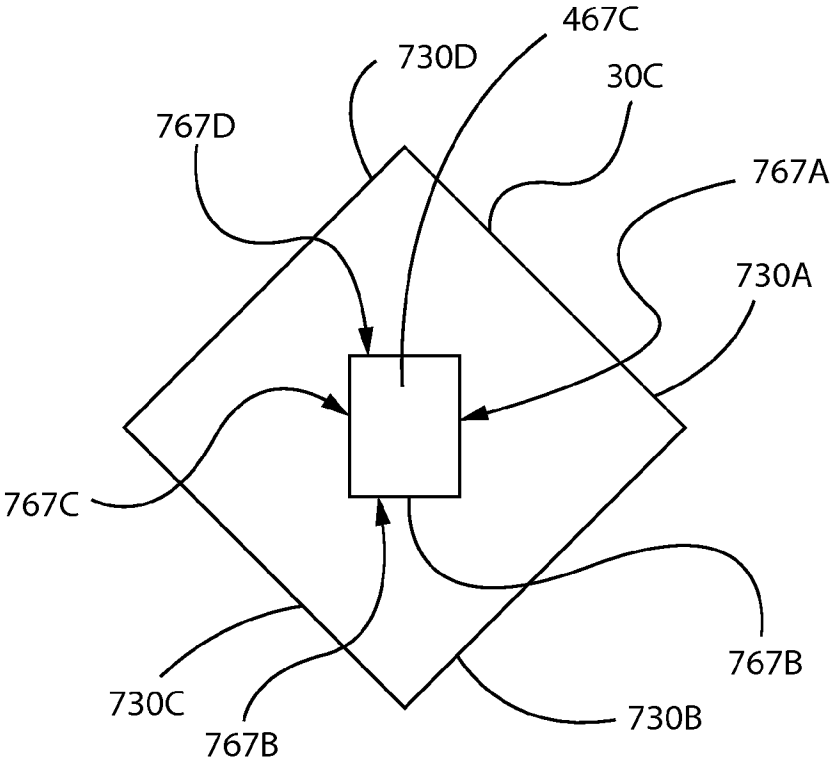

The reflective core 461 may comprise a polished area 467 having a face 468. The polished area 467 of the reflective core 461 is that portion of the reflective core 461 disposed within the indication element 30. The remainder of the reflective core 461 may be polished but it does not need to be. The polished area 467 can be configured to redirect light transmitted through the transmission element to the indication element 30, the first portion 270A and/or the second portion 270B.

Where the indication element 30 is a ring, the polished area 467 may be configured in the form of a cone (See FIG. 7A). As shown in FIG. 7B, where the indication element 30 comprises a ring, a polished area 467B may comprise multiple sides 767A-767D. As shown in FIG. 7C, an indication element 30C may comprise multiple sides 730A, 730B, 730C, 730D. And, a polished area 467C may similarly comprise multiple sides 767A-767D. As shown, the sides of the polished area 467C may be positioned at an angle with respect to the sides of the indication element 30C. As shown in FIG. 7D, an indication element 30D may comprise multiple sides 730A-730D. And, a polished area 467D may comprise multiple sides 767A-767D. The sides of the polished area 467D may be substantially parallel to the sides of the indication element 30D. It is believed that such arrangements may produce a different visual effect than that of a polished area 467 which is conical.

Referring back to FIG. 6, the reflective core 461 as shown can be a recess which remains empty in the final product. In some embodiments, the reflective core 461 may be partially filled with a material. Where the reflective core 461 is partially filled, an air gap between the filling material and the polished area 467 may be provided. The existence of this air gap can ensure that internal reflection is maintained within the indication element 30. In some embodiments, the reflective core 461 may be completely filled with material which has a lower refractive index than that of the material of the reflective core.

It is believed that without the reflective core 461 less than about 10 percent of the light provided by the output source would be emitted by the indication element 30. And, it is believed that with the reflective core 461 about 90 percent or more of the light provided by the output source would be emitted by the indication element 30, the first portion 270A and/or the second portion 270B. In some embodiments, the light emitted by the indication element 30 is greater than about 10 percent of the light provided by the output source, greater than about 20 percent, greater than about 30 percent, greater than about 40 percent, greater than about 50 percent, greater than about 60 percent, greater than about 70 percent, greater than about 80 percent, greater than about 90 percent, less than about 100 percent, less than about 90 percent, less than about 80 percent, less than about 70 percent, less than about 60 percent, less than about 50 percent, less than about 40 percent, less than about 30 percent, less than about 20 percent, or any number within the values listed above or any ranges comprising and/or within the values above. A test method for measuring the light emission efficiency is discussed hereafter.

Toothbrushes constructed in accordance with the present invention may provide feedback to the user via the indication element for a variety of conditions. For example, during a brushing session, a visible signal may be provided when the user has brushed their teeth for a predetermined amount of time, e.g. two minutes, three minutes, etc. As another example, a visible signal may be provided to the user regarding when the brush should be replaced. As yet another example, a visible signal may be provided to the user regarding the time the user has brushed over a number of brushing routines. In such embodiments, a first signal may be provided where the user has successfully brushed for a requisite period of time, e.g. two minutes, for a predetermined number of brushing routines. A second signal may be provided to the user where the user has not brushes the requisite time for each and every of the predetermined number of brushing routines.

The signal provided to the user may be constant, e.g. provide a signal to the user during the entire brushing routine. Alternatively, the signal provided to the user can be provided at the end of the brushing routine. For example, where the user has not brushed for the predetermined amount of time, e.g. two minutes, in a previous brushing routine, the signal provided to the user may flash red or show a red visible signal for a predetermined time period during a subsequent brushing routine. As another example, where the user brushed for a predetermined amount of time during a previous brushing routine, the signal provided to the user may flash green or show a green visible signal for a predetermined period of time.

In other embodiments, the signal can be provided to the user intermittently during the brushing routine. For example, the signal can be provided to the user on predetermined time intervals. For example, a signal may be provided to the user every 20 seconds. Any suitable time interval can be selected. For example, the time interval between signals can be greater than about 0.1 second, greater than about 0.2 seconds, greater than about 0.3 seconds, greater than about 0.4 seconds, greater than about 0.5 seconds, greater than about 0.6 seconds, greater than about 0.7 seconds, greater than about 0.8 seconds, greater than about 0.9 seconds, greater than about 1 second, greater than about 2 seconds, greater than about 3 seconds, greater than about 4 seconds, greater than about 5 seconds, greater than about 6 seconds, greater than about 10 seconds, greater than about 15 seconds, greater than about 20 seconds, greater than about 25 seconds, greater than about 30 seconds, greater than about 40 seconds, greater than about 50 seconds, greater than about 60 seconds, and/or less than about 60 seconds, less than about 50 seconds, less than about 40 seconds, less than about 30 seconds, less than about 25 seconds, less than about 20 seconds, less than about 15 seconds, less than about 10 seconds, less than about 5 seconds, less than about 4 seconds, less than about 3 seconds, less than about 2 seconds, less than about 1.5 seconds, less than about 1, less than about 0.9 seconds, less than about 0.8 seconds, less than about 0.7 seconds, less than about 0.6 seconds, less than about 0.5 seconds, less than about 0.4 seconds, less than about 0.2 seconds, or less than about 0.1 seconds.

Previously, a time interval between signals was discussed. In some embodiments, a processor may be configured to modify the time interval between the signals provided to the user either during a particular brushing routine or over a series of brushing routines. For example, during a first brushing routine, if the user brushes for a predetermined amount of time, e.g. two minutes, the interval between signals to the user may be at a first time interval. If in a second brushing routine, the user does not brush for the predetermined amount of time, the signals to the user may be at a second time interval. In such an embodiment, the first time interval may be greater than the second time interval thereby providing more feedback to the user. In some embodiments, the time intervals may be switched such that the user is provided more feedback for brushing the predetermined amount of time.

The materials suitable for the insert 260 should be selected such that the insert can withstand forces, e.g. no permanent deformation, minimal deflection if any of the forward portion and or base portion applied during brushing. Additionally, suitable materials may be non-corrosive, stiff, transparent, and/or translucent. Some suitable examples of materials which may be utilized for the insert 260 include polypropylene, acrylonitrile butadiene styrene, polyoxymethylene, polyamide, acrylonitrile styrene acrylate, and polyethylene-terephthalate (PET), copolyester, combinations thereof, combinations of polyester and polycarbonate, e.g. Xylex™.

The outer shell 212 may be any suitable material. Some examples of suitable materials include polypropylene, ABS (acrylonitrile-butadiene-styrene copolymer), ASA (acrylonitrile-styrene-acrylate), copolyester, POM (polyaformaldeyde), combinations thereof, and the like. Additional suitable materials include polypropylene, nylon, high density polyethylene, other moldable stable polymers, the like, and/or combinations thereof. In some embodiments, the handle, the neck, and/or the head, may be formed from a first material and include recesses, channels, grooves, for receiving a second material which is different from the first. For example, the handle may include an elastomeric grip feature or a plurality of elastomeric grip features. The elastomers among the plurality of elastomeric grip features may be similar materials or may be different materials, e.g. color, hardness, combinations thereof or the like.

The sealing element 270 may comprise any suitable material. Some examples of suitable material include thermoplastic elastomers, silicone based materials, NBR (nitrile butadiene rubber), EPDM (ethylene propylene diene monomer), Viton™, etc.

In some embodiments, recycled and/or plant derived plastics may be utilized. For example, PET (polyethyelene terephthalate) may be utilized in some embodiments. The PET may be bio based. For example, the PET may comprise from about 25 to about 75 weight percent of a terephthalate component and from about 20 to about 50 weight percent of a diol component, wherein at least about one weight percent of at least one of the terephthalate and/or the diol component is derived from at least one bio-based material. Similarly, the terephthalate component may be derived from a bio based material. Some examples of suitable bio based materials include but are not limited to corn, sugarcane, beet, potato, starch, citrus fruit, woody plant, cellulosic lignin, plant oil, natural fiber, oily wood feedstock, and a combination thereof.

Some of the specific components of the PET may be bio based. For example, monoethylene glycol and terephthalic acid may be formed from bio based materials. The formation of bio based PET and its manufacture are described in United States Patent Application Publication Nos. 20090246430A1 and 20100028512A1.

In some embodiments, the toothbrush may include a replaceable head, e.g. 14 and/or neck 16. Specifically, the head 14 may be removable from the neck 16 and/or the neck 16 may be removable from the handle 12. Herein, whether the head 14 is removable from the neck 16 or the neck 16 is removable from the handle 12, such replaceable elements will be termed "refills". In such embodiments, the processor may be programmed with a plurality of algorithms in order to establish a time period for cumulative use of a particular refill and/or for identification of a particular use. Some suitable examples of oral care implements which can recognize a particular refill are described in U.S. Pat. Nos. 7,086,111; 7,207,080; and 7,024,717.

The interconnectivity between the neck 16 and the handle region 12 can be provided in any suitable manner. Some suitable embodiments are discussed with regard to U.S. Pat. Nos. 7,086,111, 7,207,080, and 7,024,717.

The toothbrush of the present invention may further comprise a power source as discussed previously. The power source may be any suitable element which can provide power to the toothbrush. A suitable example includes batteries. The battery may be sized in order to minimize the amount of real estate required inside the toothbrush. For example, where the output source consists of a light emitting element the power source may be sized relatively small, e.g. smaller than a triple A battery. The battery may be rechargeable or may be disposable. Additionally, a plurality of batteries may be utilized. In some embodiments, the power source may include alternating current power as provided by a utility company to a residence. Other suitable power sources are described in U.S. patent application Ser. No. 12/102,881, filed on Apr. 15, 2008, and entitled, "Personal Care Products and Methods".

In some embodiments, a user operated switch may be provided which can allow the user to control when timing indication begins. The switch (shown may be in electrical communication with the power source and the output signal element and/or the timer.

The elastomeric grip features of the handle may be utilized to overmold, at least in part, a portion of the timer, output signaling element, processor, cap, and/or power source. In such embodiments, these components may be in electrical communication via wiring which can similarly be overmolded. The elastomeric grip features may include portions which are positioned for gripping by the palm of the user and/or portions which are positioned for gripping by the thumb and index finger of the user. These elastomeric grip features may be composed of the same material or may be different, e.g. color, shape, composition, hardness, the like, and/or combinations thereof.

Additionally, as used herein, the term "contact elements" is used to refer to any suitable element which can be inserted into the oral cavity. Some suitable elements include bristle tufts, elastomeric massage elements, elastomeric cleaning elements, massage elements, tongue cleaners, soft tissue cleaners, hard surface cleaners, combinations thereof, and the like. The head may comprise a variety of contact elements. For example, the head may comprise bristles, abrasive elastomeric elements, elastomeric elements in a particular orientation or arrangement, e.g. pivoting fins, prophy cups, or the like. Some suitable examples of elastomeric cleaning elements and/or massaging elements are described in U.S. Patent Application Publication Nos. 2007/0251040; 2004/0154112; 2006/0272112; and in U.S. Pat. Nos. 6,553,604; 6,151,745. The cleaning elements may be tapered, notched, crimped, dimpled, or the like. Some suitable examples of these cleaning elements and/or massaging elements are described in U.S. Pat. Nos. 6,151,745; 6,058,541; 5,268,005; 5,313,909; 4,802,255; 6,018,840; 5,836,769; 5,722,106; 6,475,553; and U.S. Patent Application Publication No. 2006/0080794.

The contact elements may be attached to the head in any suitable manner Conventional methods include stapling, anchor free tufting, and injection mold tufting. For those contact elements that comprise an elastomer, these elements may be formed integral with one another, e.g. having an integral base portion and extending outward therefrom.

The head may comprise a soft tissue cleanser constructed of any suitable material. Some examples of suitable material include elastomeric materials; polypropylene, polyethylene, etc; the like, and/or combinations thereof. The soft tissue cleanser may comprise any suitable soft tissue cleansing elements. Some examples of such elements as well as configurations of soft tissues cleansers on a toothbrush are described in U.S. Patent Application Nos. 2006/0010628; 2005/0166344; 2005/0210612; 2006/0195995; 2008/0189888; 2006/0052806; 2004/0255416; 2005/0000049; 2005/0038461; 2004/0134007; 2006/0026784; 20070049956; 2008/0244849; 2005/0000043; 2007/140959; and U.S. Pat. Nos. 5,980,542; 6,402,768; and 6,102,923.

For those embodiments which include an elastomeric element on a first side of the head and an elastomeric element on a second side of the head (opposite the first), the elastomeric elements may be integrally formed via channels or gaps which extend through the material of the head. These channels or gaps can allow elastomeric material to flow through the head during an injection molding process such that both the elastomeric elements of the first side and the second side may be formed in one injection molding step.

Test Method for Determining Light Emission Efficiency

Obtain three samples of the brush to be tested and three samples of the output source utilized in the brush. The samples of the output source should be identical to that utilized in the brush. Take all samples, i.e. three brush samples and three samples of the output source, to an independent testing facility. The testing facility will test each of the three samples of the brush and each of the samples of the output source in an appropriately sized integrating sphere. For example, a 12 inch integrating sphere may be suitable to fit the brush samples.

The testing facility will calibrate all equipment prior to measurement of any samples. The samples of the output source will be tested prior to the testing of the brushes. The testing facility will place one sample of the output source in the integrating sphere in accordance with standard testing procedures. The output source will be powered by the same voltage as that provided in the brush. Specifically, if the brush utilizes two 1.5 volt watch batteries, then the output source shall similarly be powered by two 1.5 volt watch batteries.

The output source shall be powered on, the integrating sphere closed, and the total light radiated from the output source shall be measured. Each of the remaining samples of output source shall be measured similarly. The total light output of each of the samples of output source will be recorded and noted by each sample.

Remove the sample output source from the integrating sphere prior to testing a sample brush. Place a sample brush in the integrating sphere configured in such a manner as to activate the output source of the brush without blocking the light emitted from the indication element of the brush. For example, where the indication element provides a visual indication of too much pressure being applied, a harness may be utilized to move the head/neck of the brush to ensure that the indication element/output source is activated. Measure the total light radiated from the sample brush. Repeat for the remaining samples of brush.

The total light radiated from sample output source one will be divided by the total light radiated from sample brush one. The quotient is then multiplied by 100 to determine percent one. The total light radiated from sample output source two will be divided by the total light radiated from sample brush two. The quotient is then multiplied by 100 to determine percentage two. The total light radiated from sample output source three will be divided by the total light radiated from sample brush three. The quotient is then multiplied by 100 to determined percentage three. The percentages one, two, and three, are averaged to obtain the percent efficiency.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An oral hygiene implement comprising a handle, a head, and a neck disposed between the handle and the head, the head comprising a plurality of contact elements, the oral hygiene implement further comprising:

an indication element having an outer periphery;

an output source in signal communication with the indication element; and a reflective core disposed within the indication element, wherein the reflective core redirects light from the output source to the outer periphery of the indication element; wherein the reflective core comprises a polished area having an outer surface; wherein the outer periphery of the indication element includes a first plurality of sides; and wherein the outer surface of the polished area has a second plurality of sides, the first plurality of sides being substantially parallel to the second plurality of sides.

2. The oral hygiene implement of claim 1, wherein the handle comprises an outer shell with an insert having a base portion disposed therein.

3. The oral hygiene implement of claim 2, wherein the insert further comprises a forward portion, the forward portion comprising a transmission element in signal communication with the reflective core.

4. The oral hygiene implement of claim 2, wherein the indication element is sandwiched between a first portion and a second portion of a sealing element.

5. The oral hygiene implement of claim 4, wherein the first portion or the second portion comprise a thermoplastic elastomer.

6. The oral hygiene implement of claim 4, wherein the first portion or the second portion are translucent.

7. The oral hygiene implement of claim 6, wherein the first portion or the second portion comprise a first color.

8. The oral hygiene implement of claim 7, wherein the output source comprises a light emitting device capable of emitting a second color, and wherein the first color and the second color are different.

9. The oral hygiene implement of claim 8, wherein the light emitted goes through the first portion or the second portion.

10. The oral hygiene implement of claim 7, wherein the output source comprises a light emitting device capable of emitting a second color, and wherein the first color and the second color are similar.

11. The oral hygiene implement of claim 10, wherein the light emitted goes through the first portion or the second portion.

12. The oral hygiene implement of claim 4, wherein the first portion or the second portion are transparent.

13. The oral hygiene implement of claim 1, wherein the first plurality of sides are at an angle with the second plurality of sides.

14. An oral hygiene implement comprising a handle, a head, and a neck disposed between the handle and the head, the head comprising a plurality of contact elements, the oral hygiene implement further comprising:

an indication element having an outer periphery;

an output source in signal communication with the indication element; and a reflective core disposed within the indication element, wherein the reflective core redirects light from the output source to the outer periphery of the indication element; wherein the reflective core comprises a polished area having an outer surface; and wherein the outer surface of the polished area is at a uniform distance from the outer periphery of the indication element.

15. An oral hygiene implement comprising a handle, a head, and a neck disposed between the handle and the head, the head comprising a plurality of contact elements, the oral hygiene implement further comprising:

an indication element having an outer periphery;

an output source in signal communication with the indication element; and a reflective core disposed within the indication element, wherein the reflective core redirects light from the output source to the outer periphery of the indication element; wherein the reflective core comprises a polished area having an outer surface; and wherein the outer surface of the polished area is variably spaced from the outer periphery of the indication element.

* * * * *